US007004787B2

(12) United States Patent
Milan

(10) Patent No.: US 7,004,787 B2
(45) Date of Patent: Feb. 28, 2006

(54) UNIVERSAL COMPUTER CABLE WITH QUICK CONNECTORS AND INTERCHANGEABLE ENDS, AND SYSTEM AND METHOD UTILIZING THE SAME

(76) Inventor: Henry Milan, 1709 Apple Ridge Ct., Rochester Hills, MI (US) 48306

( * ) Notice: Subject to any disclaimer, the term of this patent is extended or adjusted under 35 U.S.C. 154(b) by 0 days.

(21) Appl. No.: 10/328,519

(22) Filed: Dec. 23, 2002

(65) Prior Publication Data

US 2003/0228791 A1 Dec. 11, 2003

Related U.S. Application Data

(60) Provisional application No. 60/401,900, filed on Aug. 8, 2002, provisional application No. 60/387,796, filed on Jun. 11, 2002.

(51) Int. Cl.
*H01R 11/00* (2006.01)

(52) U.S. Cl. ..... 439/502; 439/680

(58) Field of Classification Search ..... 439/502, 439/501, 180, 660, 668, 499, 680
See application file for complete search history.

(56) References Cited

U.S. PATENT DOCUMENTS

| | | | | |
|---|---|---|---|---|
| 2,776,415 | A | | 1/1957 | McGinley |
| 3,885,849 | A | | 5/1975 | Bailey et al. |
| 4,057,310 | A | * | 11/1977 | Young ..... 439/35 |
| 4,310,213 | A | | 1/1982 | Fetterolf, Sr. et al. |
| D295,971 | S | | 5/1988 | Kikuta |
| 4,824,383 | A | * | 4/1989 | Lemke ..... 439/108 |
| 4,846,697 | A | * | 7/1989 | Rodgers ..... 439/35 |
| 5,119,020 | A | * | 6/1992 | Massey et al. ..... 324/754 |
| 5,197,900 | A | | 3/1993 | Ellis et al. |
| 5,236,373 | A | | 8/1993 | Kennedy |
| 5,293,013 | A | * | 3/1994 | Takahashi ..... 200/51 R |
| 5,315,062 | A | | 5/1994 | Hoshino |
| 5,370,550 | A | | 12/1994 | Alwine et al. |
| 5,425,653 | A | | 6/1995 | Koiso |
| 5,445,534 | A | | 8/1995 | Ishizuka et al. |
| 5,637,009 | A | | 6/1997 | Tsuji et al. |
| 5,658,170 | A | | 8/1997 | Tan et al. |
| 5,692,918 | A | | 12/1997 | Hill |
| 5,772,453 | A | | 6/1998 | Tan et al. |
| 5,772,472 | A | | 6/1998 | Beutler et al. |
| 5,823,814 | A | | 10/1998 | Alwine |
| D405,053 | S | | 2/1999 | Tan et al. |
| 5,954,523 | A | | 9/1999 | Babcock |
| 5,961,351 | A | | 10/1999 | Wu |
| 5,975,954 | A | | 11/1999 | Wu et al. |
| 6,007,380 | A | | 12/1999 | Shimojo |
| 6,007,382 | A | | 12/1999 | Wu |
| 6,010,348 | A | | 1/2000 | Alden |

(Continued)

FOREIGN PATENT DOCUMENTS

| | | |
|---|---|---|
| DE | 100 31 954 | 3/2001 |

(Continued)

*Primary Examiner*—Thanh-Tam Le
(74) *Attorney, Agent, or Firm*—Butzel Long

(57) ABSTRACT

A universal cable and system are provided that includes a universal cable and miniature quick connectors with interchangeable ends. The system allows for easy construction of various desired cable configurations that may include USB and Firewire® computer architecture, and other electrical communication wiring schemes. As a result, electrical connection between computers, computer peripherals, and other electrical equipment is quickly accomplished without a need for many cables and connectors, and their associated added costs. Universal cabling methods for using the system and cables are also provided.

7 Claims, 7 Drawing Sheets

U.S. PATENT DOCUMENTS

| | | | | |
|---|---|---|---|---|
| 6,080,012 | A | 6/2000 | Zhu et al. | |
| 6,089,879 | A | 7/2000 | Babcock | |
| 6,155,872 | A | 12/2000 | Wu | |
| 6,171,136 | B1 | 1/2001 | Liu et al. | |
| 6,183,292 | B1 | 2/2001 | Chen et al. | |
| 6,210,231 | B1 | 4/2001 | Lai | |
| 6,215,656 | B1 | 4/2001 | O'Neal et al. | |
| 6,217,378 | B1 | 4/2001 | Wu | |
| 6,220,872 | B1 | 4/2001 | Chen | |
| D443,251 | S | 6/2001 | Wang et al. | |
| 6,250,955 | B1 | 6/2001 | Archuleta | |
| 6,257,930 | B1 | 7/2001 | Yu | |
| 6,302,721 | B1 | 10/2001 | Turner et al. | |
| 6,309,255 | B1 | 10/2001 | Yu | |
| 6,334,793 | B1 | 1/2002 | Amoni et al. | |
| 6,346,002 | B1 | 2/2002 | Hsu et al. | |
| 6,358,088 | B1 | 3/2002 | Nishio et al. | |
| 6,466,437 | B1 | 10/2002 | Sakuragi et al. | |
| 6,663,420 | B1 * | 12/2003 | Xiao | 439/502 |
| 6,728,108 | B1 * | 4/2004 | Chen | 361/736 |

FOREIGN PATENT DOCUMENTS

| | | |
|---|---|---|
| EP | 1 096 760 | 5/2001 |
| EP | 1 100 158 | 5/2001 |
| GB | 2 332 103 | 6/1999 |
| JP | P2001-209460 | 3/2001 |

* cited by examiner

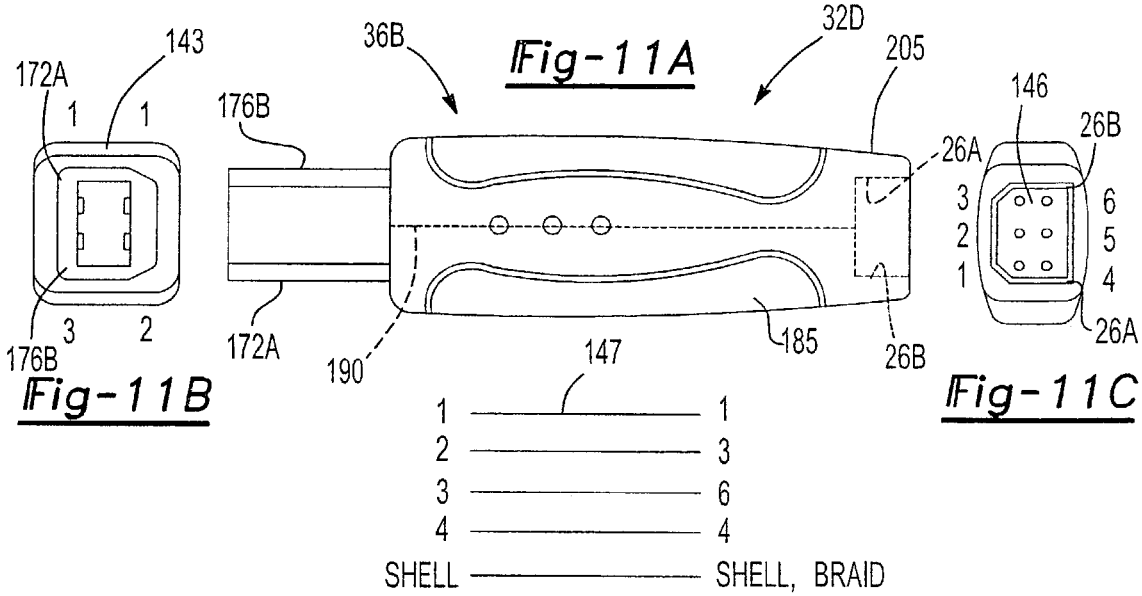
Fig-11A
Fig-11B
Fig-11C
Fig-11D
36B
32D
205
143
172A
176B
146
26B
26A
190
185
147
SHELL
SHELL, BRAID
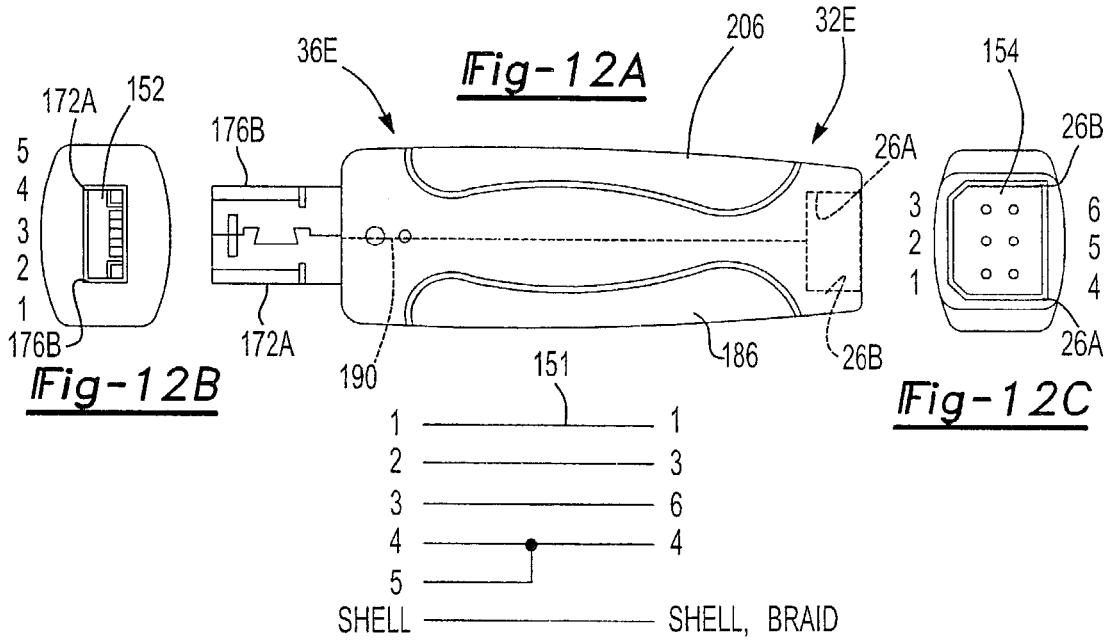
Fig-12A
Fig-12B
Fig-12C
Fig-12D
36E
206
32E
154
152
172A
176B
26A
26B
190
186
151
SHELL
SHELL, BRAID

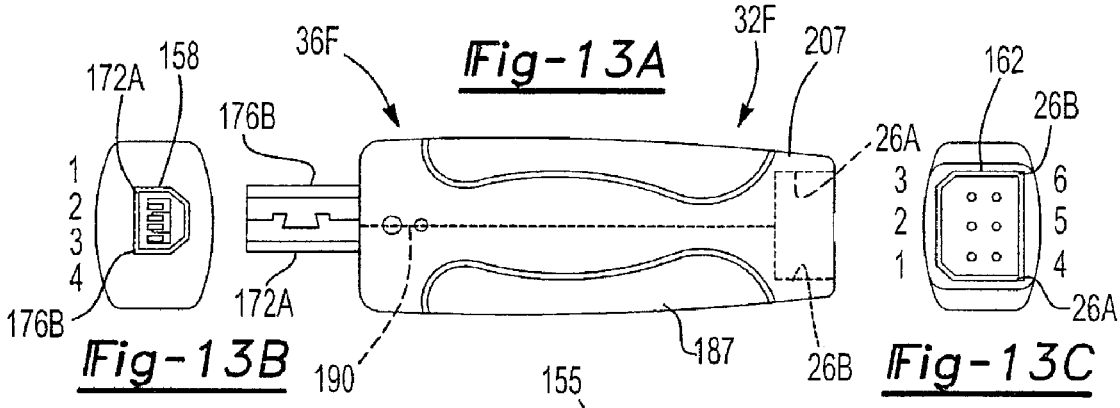
Fig-13A
Fig-13B
Fig-13C
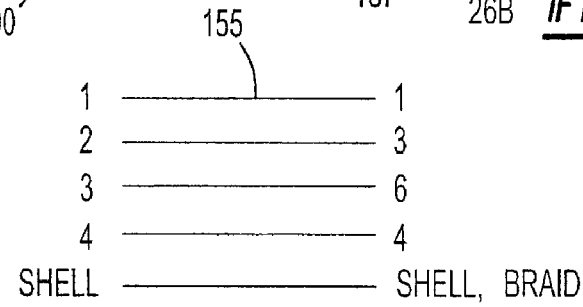
Fig-13D

UNIVERSAL COMPUTER CABLE WITH QUICK CONNECTORS AND INTERCHANGEABLE ENDS, AND SYSTEM AND METHOD UTILIZING THE SAME

RELATED APPLICATIONS

This application claims the benefit of U.S. Provisional Patent Application Ser. No. 60/387,796, filed Jun. 11, 2002, and Ser. No. 60/401,900, filed Aug. 8, 2002, which applications are incorporated herein in their entirety. Application Ser. Nos. 60/387,706 and 60/401,900 are co-pending as of the filing date of the present application.

FIELD OF THE INVENTION

The present invention relates to computers, computer peripherals, computer related devices, and other devices which may benefit from a quick and efficient method and/or system for connection to other like or different devices. More particularly, the present invention relates to a system and method for connecting computers and/or computer peripherals to other computers and/or computer peripherals. Most particularly, the present invention relates to a universal computer cable having quick connectors and interchangeable ends, and a universal cabling system and method of using the connectors to connect computers, computer peripherals, computer related devices and other devices together.

DESCRIPTION OF RELATED ART

The fields of computers, computer peripherals, and computer related devices are rapidly expanding. All of these devices must be connected to one another to communicate. This has caused a problem in the art due to the large number of conventional connector types and cable lengths, which are currently used. Many of these devices currently use universal serial bus (USB) or Firewire® computer architecture.

The USB architecture uses a four wire cable, or whatever the current USB specification calls for, usually in six, ten, or fifteen foot lengths, having seven different configurations possible on one end of the cable, and three different configurations possible on the other end of the cable, making possible many different configurations in each of the three popular lengths. Current USB Standards do not permit a cable length greater than fifteen feet without a repeater.

Five different types of plugs (male) or receptacles (female) are used on the ends of the USB cables to form these configurations. These are a USB A Male, USB B Male, MiniUSB A Male and MiniUSB B Male plugs, as well as a USB A Female receptacle. Any one of these plugs or receptacles may be found on either end of a USB cable. The only limitation on the possible combinations is that an A Male USB plug is not used with a MiniUSB A Male plug, and a MiniUSB B Male plug is not used with a USB B Male plug.

Firewire® computer architecture uses a four or six wire cable, or whatever the current Firewire® specification calls for, usually in the same lengths as a USB cable, and having a six pin Firewire® computer connector on one or both ends of a Firewire® cable, and a four pin audio-visual connector, which also may be on one, or both, ends of a Firewire® cable, thus providing additional cable configurations.

The large number of cable configurations causes problems in the art for the computer and/or peripheral, or device manufacturer, the wholesaler, the retailer, and the user, all of whom are put to the expense of manufacturing and/or stocking and/or selling and/or buying and/or using a bewildering array of cables to connect computers and/or computer peripherals to other computers and/or computer peripherals or devices. Thus, those skilled in the art have begun to search for an easier and less costly way to accomplish these connections.

SUMMARY OF THE INVENTION

The present invention solves the aforementioned problems in the art by providing a universal computer cable useable for USB or Firewire® computer architecture, and having novel quick connectors which provide for the use of interchangeable ends on the cable, and a cabling system and method of using the cable and quick connectors to connect computers, computer peripherals, computer related devices, and other devices together.

BRIEF DESCRIPTION OF THE DRAWINGS

FIG. 9A is an elevational view of a second modification of the construction shown in FIG. 7A.

FIG. 9B is a left side view of the construction of FIG. 9A.

FIG. 9C is a right side view of the construction of FIG. 9A.

FIG. 10A is an elevational view of a third modification of the construction shown in FIG. 7A.

FIG. 10B is a left side view of the construction of FIG. 10A.

FIG. 10C is a right side view of the construction of FIG. 10A.

FIG. 11A is an elevational view of a forth modification of the construction shown in FIG. 7A;

FIG. 11B is a left side view of the construction of FIG. 11A.

FIG. 11C is a right side view of the construction of FIG. 11A.

FIG. 11D is a pin-out diagram of the construction of FIG. 11A.

FIG. 12A is an elevational view of a fifth modification of the construction shown in FIG. 7A.

FIG. 12B is a left side view of the construction of FIG. 12A.

FIG. 12C is a right side view of the construction of FIG. 12A.

FIG. 12D is a pin-out diagram of the construction of FIG. 12A.

FIG. 13A is an elevational view of a sixth modification of the construction shown in FIG. 7A.

FIG. 13B is a left side view of the construction of FIG. 13A.

FIG. 13C is a right side view of the construction of FIG. 13A.

FIG. 13D is a pin-out diagram of the construction of FIG. 13A.

It is to be understood that the present invention is not limited to the details of construction and arrangement of parts illustrated in the accompanying drawings, since the present invention is capable of other embodiments and of being practiced or carried out in various ways within the scope of the claims. Also, it is to be understood that the phraseology and terminology employed herein is for the purpose of description, and not of limitation.

DETAILED DESCRIPTION OF THE PREFERRED EMBODIMENTS

Figure 1:
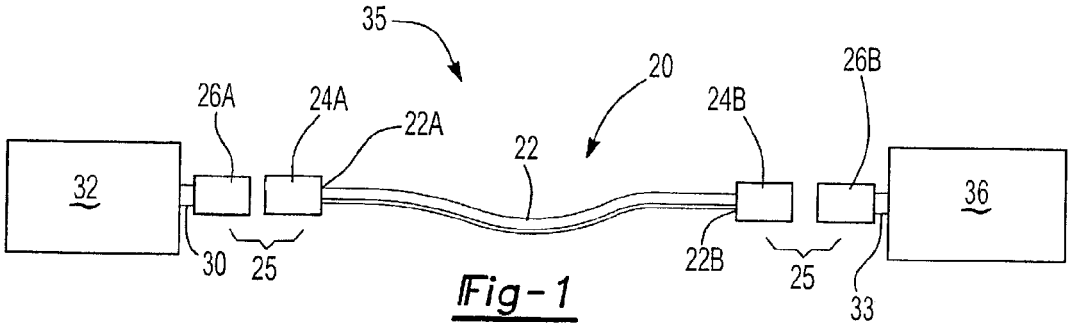
FIG. 1 is a diagrammatic view of a construction embodying the present invention.

Referring to FIG. 1, there is illustrated a diagrammatic view of a universal cable system, generally indicated by the numeral 35, which generally includes a universal cable 20 having a universal cable portion 22. The universal cable portion 22 comprises a predetermined length of a USB cable, Firewire® cable, or other suitable cable for the purpose intended. The universal cable portion 22 has a universal cable portion first end and a universal cable portion second end, 22A and 22B, respectively.

The universal cable portion first end 22A is mechanically and electrically attached to a universal cable first connector portion 24A and the universal cable portion second end 22B is mechanically and electrically attached to a universal cable second connector portion 24B, said portions 24A and 24B preferably are, but not necessarily, female. Hence the universal cable first connector portion 24A is in electrical communication with the universal cable second connector portion 24B. Thus the combination of the universal cable portion 22, and the universal connector portions 24A and 24B define the basic universal cable 20. In the first preferred embodiment of the present invention, the universal cable first connector portion 24A is identical to universal cable second connector portion 24B.

Also shown in FIG. 1 are two universal cable connectors 25, which comprise a combination of the universal cable first connector portion 24A and a quick connect first mating connector portion 26A, or a combination of the universal cable second connector portion 24B and a quick connect second mating connector portion 26B. Thus the universal cable 20 may be further defined as the combination of the universal cable portion 22 and the two universal cable connectors 25. If the universal cable 20 is mateably attached to first and second USB or Firewire® plugs, receptacles, or converters (32 and 36 respectively), then the universal cable 20 of the present invention may be referred to as a universal USB cable or a universal Firewire® cable, respectively, of the universal cable system 35.

Figure 2:
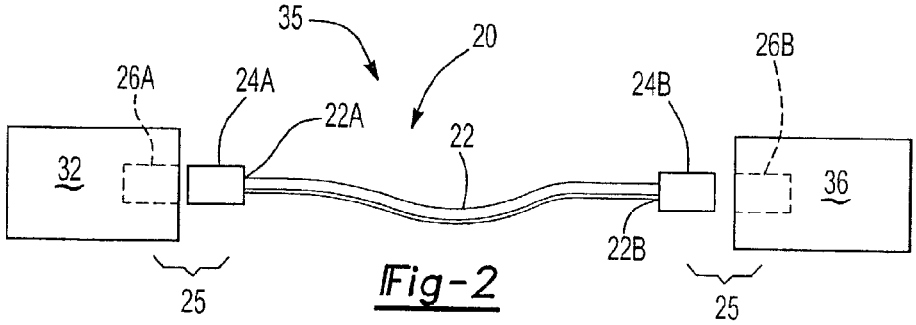
FIG. 2 is a diagrammatic view of a modification of the construction shown in FIG. 1.

Referring to FIG. 2, there is shown a modification of the present invention, which is in large part similar to that shown in FIG. 1, with an additional feature that the quick connect first mating (or male) connector portion 26A is formed integrally with the first serial bus plug, Firewire® plug, receptacle or converter 32. Similarly, the quick connect second mating (or male) connector portion 26B is formed integrally with the second USB plug, receptacle, Firewire® plug, or converter 36. Thus the quick connect first cable portion 30 and quick connect second cable portion 33 are eliminated, making the modification of the invention shown in FIG. 2 simpler and less costly to produce than the version shown in FIG. 1.

Figure 3:
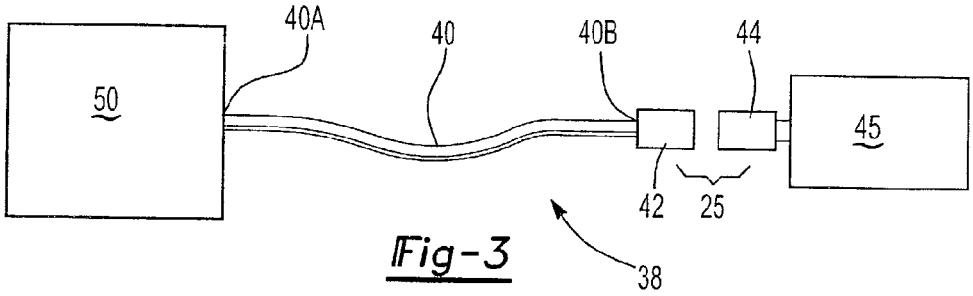
FIG. 3 is a diagrammatic view of a further modification of the present invention.

Referring to FIG. 3, a universal serial bus cabling system 38 may be provided, in accordance with the present invention, by providing a universal serial bus cable portion 40, or one of the other types of cables mentioned above. The universal serial bus cable having a universal serial bus cable first end 40A and a universal serial bus cable second end 40B with at least a universal first system connector 42 electrically connected to the universal serial bus cable second end 40B. Further provided is at least one quick connect system serial bus plug or receptacle or converter 45, which may be miniature in size, and having a quick connect system mating connector 44 that is capable of making mateable electrical and mechanical attachment to the universal first system connector 42. With the universal serial bus cable first end 40A of the universal serial bus cable 40 being electrically and mechanically connected to a computer, computer peripheral, computer related device, or other device 50, the present invention is thus capable of providing a universal serial bus cabling system 38 that possesses interchangeability of plugs, receptacles, Firewire® plugs, or converters for electrical communications between computer peripherals and/or computers or other electronic devices.

Figure 4:
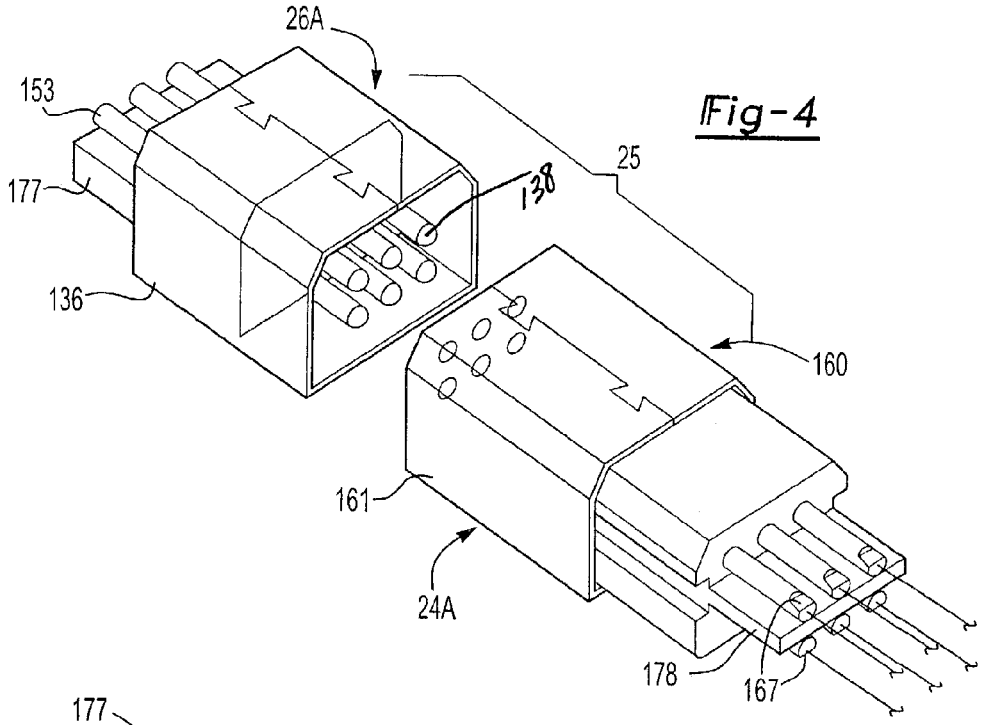
FIG. 4 is an exploded, perspective, view of a construction embodying the present invention.

Referring to FIG. 4, there is illustrated a universal cable connector 25 comprising the universal cable first (typically, female) connector portion 24A, and the universal cable quick connect first mating (typically, male) connector portion 26A. In the present invention a combination of the universal cable second (typically, female) connector portion 24B and the universal cable quick connect second mating (typically, male) connector portion 26B, and a combination of the universal first system connector 42 and the quick connect system mating connector 44 also form a universal cable connector 25.

Figure 6A:
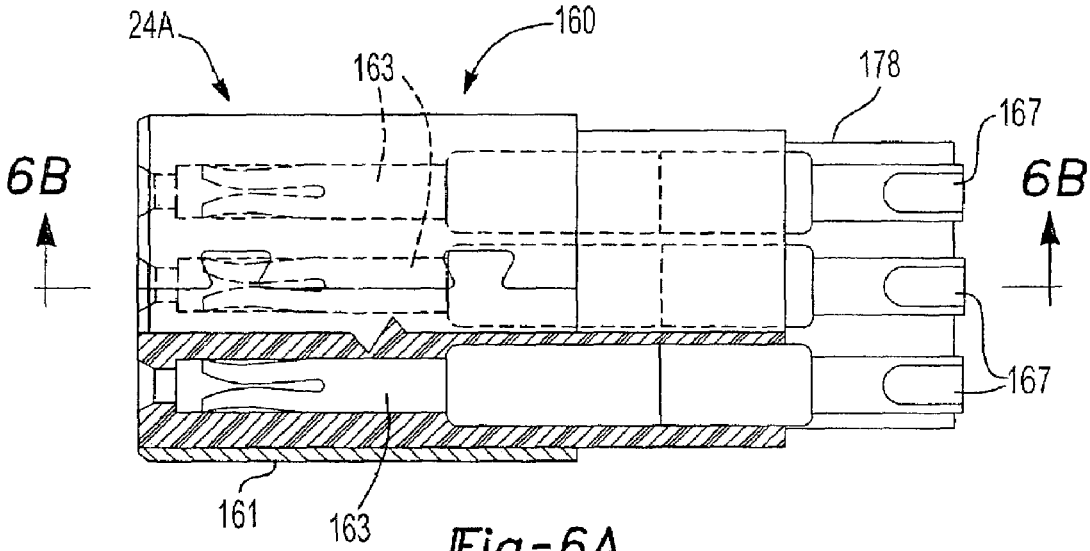
FIG. 6A is a top plan view, partially in section, of the female portion of the construction illustrated in FIG. 4.
Figure 6B:
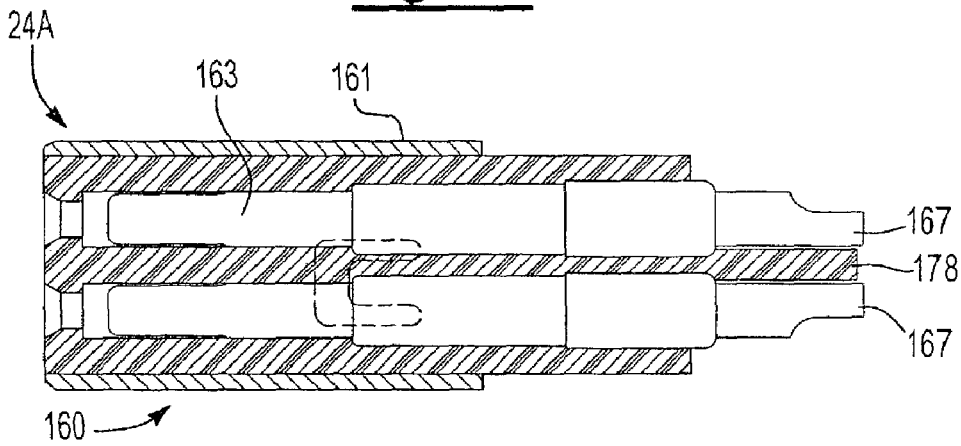
FIG. 6B is a sectional view, taken in the direction of the arrows, along the section line 6B—6B of FIG. 6A.
Figure 6C:
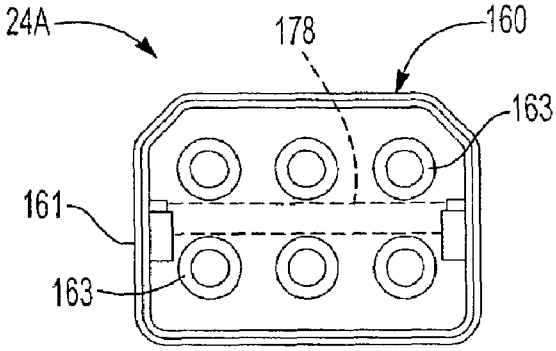
FIG. 6C is a left end view of the construction shown in FIG. 6B.
Figure 7B:
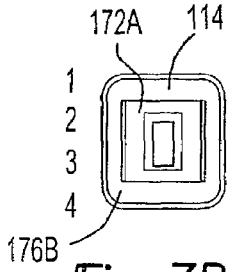
FIG. 7B is a left side view of the construction of FIG. 7A.
Figure 7A:
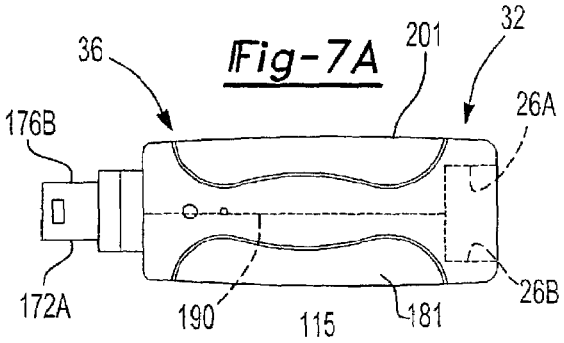
FIG. 7A is an elevational view of a plug, receptacle or converter embodying the construction shown in FIG. 5A.
Figure 7C:
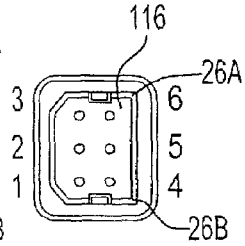
FIG. 7C is a right side view of the construction of FIG. 7A.
Figure 7D:
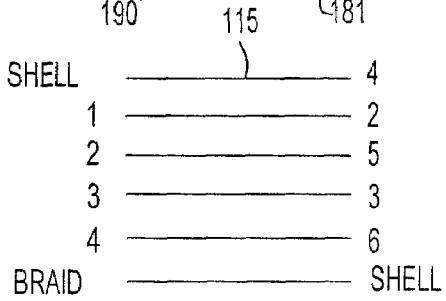
FIG. 7D is a pin-out diagram of the construction of FIG. 7A.
Figure 8B:
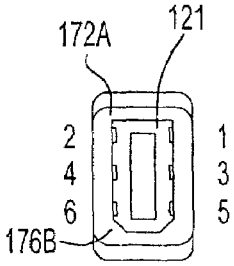
FIG. 8B is a left side view of the construction of FIG. 8A.
Figure 8A:
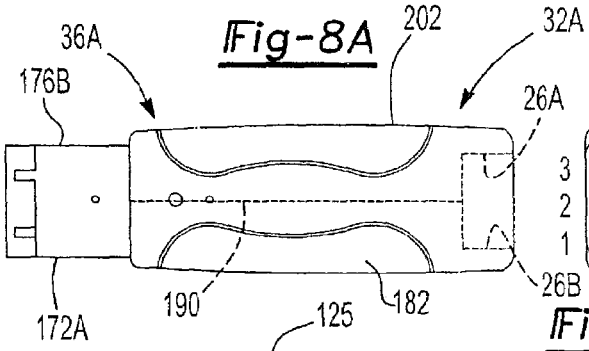
FIG. 8A is an elevational view of a first modification of the construction shown in FIG. 7A.
Figure 8C:
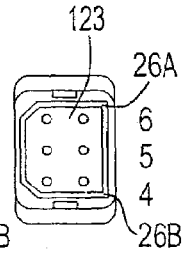
FIG. 8C is a right side view of the construction of FIG. 8A.
Figure 8D:
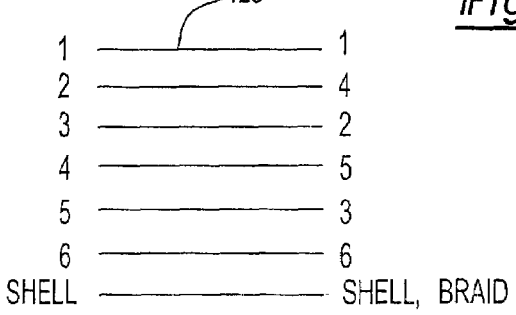
FIG. 8D is a pin-out diagram of the construction of FIG. 8A.
Figure 9D:
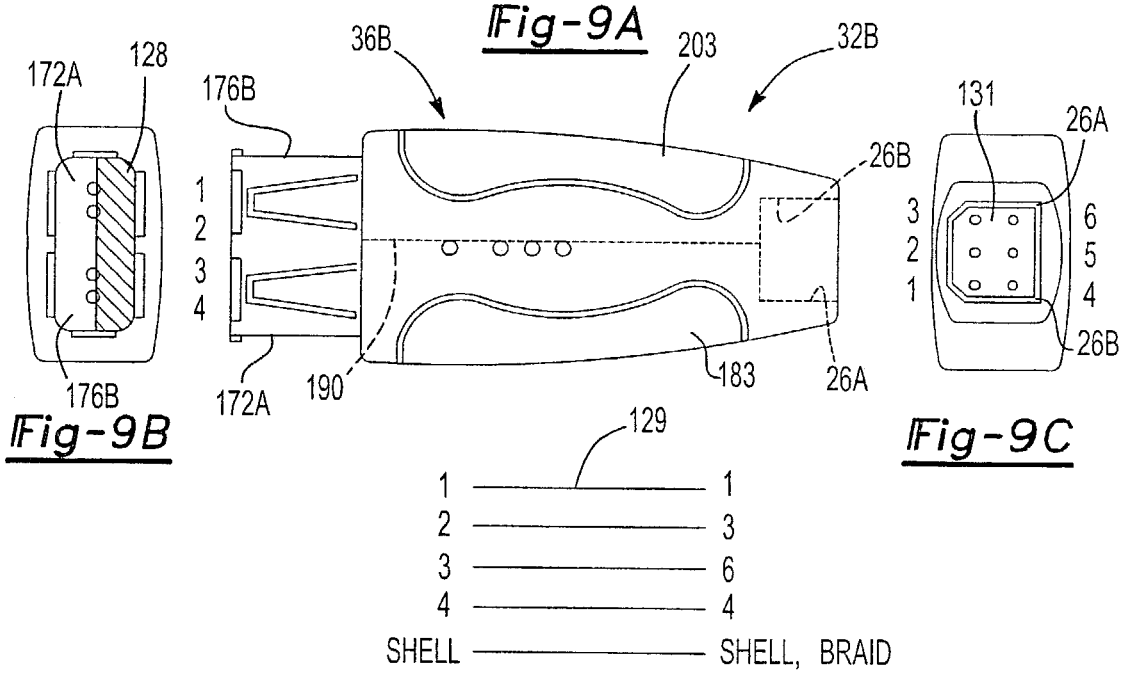
FIG. 9D is a pin-out diagram of the construction of FIG. 9A.
Figure 10D:
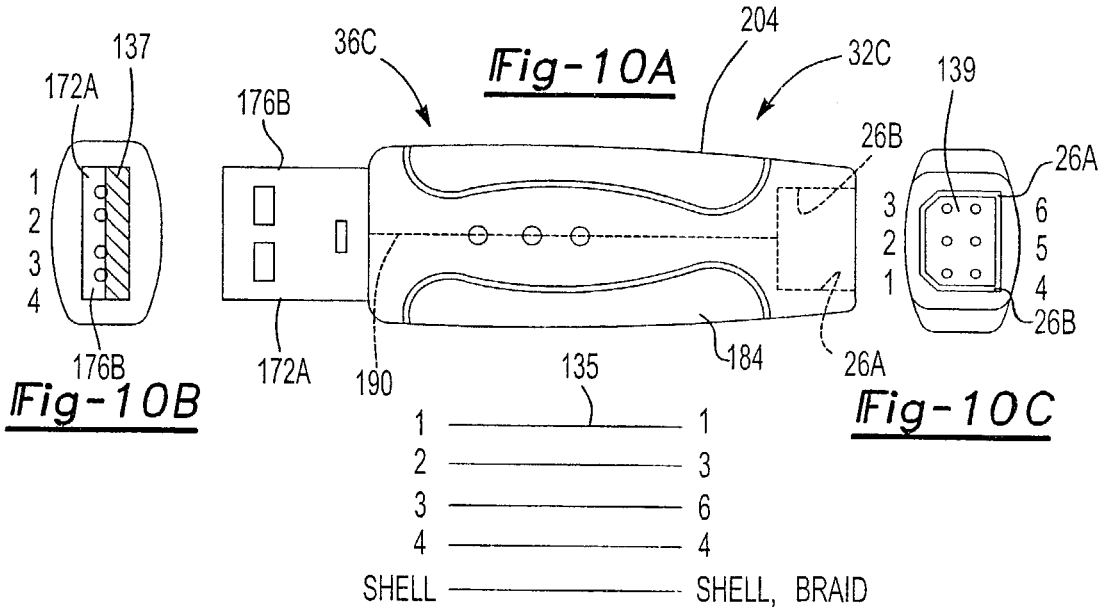
FIG. 10D is a pin-out diagram of the construction of FIG. 10A.

As shown in FIGS. 6A–C, the universal cable first connector portion 24A (as does the universal cable second mating connector portion 24B and the universal first system connector 42) comprises a six pin female connector 160 having a female connector body 161 having a universal connector shelf 178 that electrically and mechanically isolates the two sets of three female pins 163 that are mechanically attached to, or held in fixed relation to the connector body 161 by means well known in the art, such as molding.

The female pins 163 have female cable connection points 167, which are the means for making electrical connections to the connector portions 24A, 24B (FIG. 2), and 42 (FIG. 3).

Figure 5A:
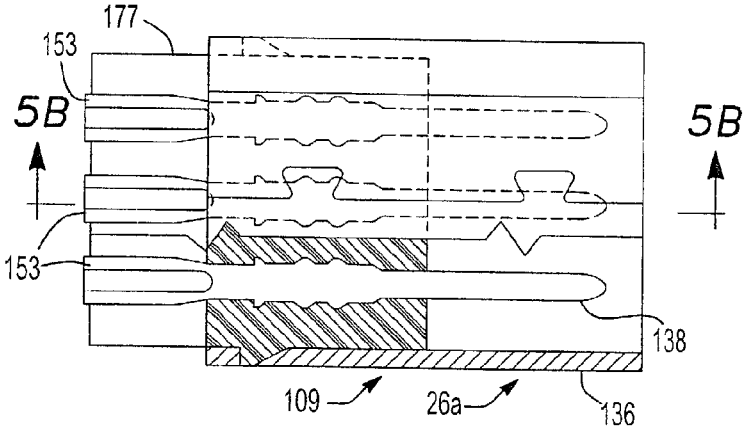
FIG. 5A is a top plan view, partially in section, of the male portion of the construction illustrated in FIG. 4.
Figure 5B:
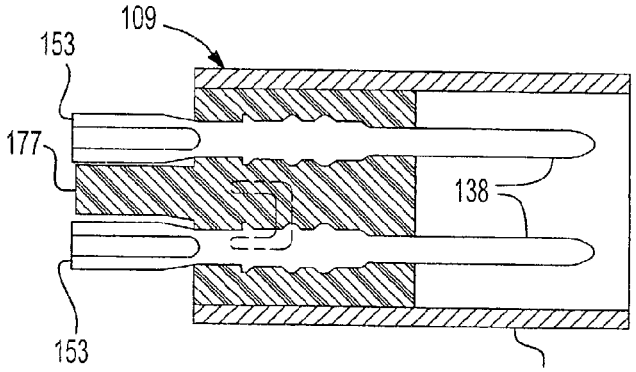
FIG. 5B is a sectional view, taken in the direction of the arrows, along the section line 5B—5B of FIG. 5A.
Figure 5C:
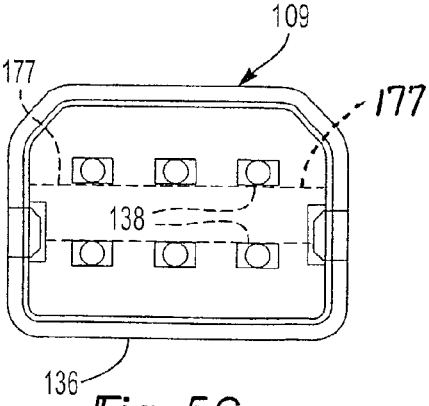
FIG. 5C is a right end view of the construction shown in FIG. 5B.

Illustrated in FIGS. 5A–C, is the universal cable quick connect first mating (male) connector portion 26A (this applies equally to 26B and 44) of the universal cable connector 25 in the form of a 6 pin male connector 109 of the present invention having six male pins 138 that are mechanically attached to, or held in place in relation to, the male connector body 136 by means well known in the art, and a connector shelf 177 that electrically and mechanically isolate each row of three male pins 138. Male cable connection points 153, which may be part of the male pins 138, aid in electrically attaching the male connector 109 to wires in a cable, for example, cable portion 22, or a converter, for example, miniature converter 32. The above-described structure applies equally as well to the universal cable quick connect second mating connector portion 26B and the connector 44.

Referring to FIGS. 7A–D, there is illustrated a first serial bus plug, Firewire® plug, receptacle, or converter 32, or second serial bus plug, Firewire® plug, receptacle or converter 36 in the form of a Firewire®—IEEE Standard 1394a-2000 201 4-Circuit Plug 201 (said standard being incorporated by reference herein in its entirety), having a first pin arrangement 114 and a second pin arrangement 116, which are mechanically and electrically connected per first pin-out diagram 115 and in electrical communication therewith.

The 4-Circuit Plug 201, when used as a first serial bus plug, Firewire® plug, receptacle or converter 32 comprises a miniature quick connect first housing 181, a third connector portion 172A, and a universal cable quick connect first mating connector portion 26A, wherein each of the connector portions 172A, 26A are in mechanical attachment with the housing 181 and in electrical attachment with the cabling 190, thus allowing electrical communications between the connector portions 172A, 26A.

Similarly, the 4-Circuit Plug 201, when used as a second serial bus plug, Firewire® plug, receptacle or converter 36 comprises miniature quick connect first housing 181, fifth connector portion 176B, and universal cable quick connect second mating connector portion 26B, wherein each of the connector portions 176B, 26B are in mechanical attachment with the housing 181 and in electrical attachment with the cabling 190, thus allowing electrical communications between the connector portions 176B, 26B.

Illustrated in FIGS. 8A–D, there is a first modified first serial bus plug, Firewire® plug, receptacle or converter 32A in the form of a Firewire®—IEEE Standard 1394-1995 (said standard being incorporated by reference herein in its entirety), 6-Circuit Plug 202 having a third pin arrangement 121 and a fourth pin arrangement 123 (substantially identical to first pin arrangement 116), which are mechanically and electrically connected per second pin-out diagram 125 and in electrical communication therewith.

The 6-Circuit plug 202, when used as a first modified first serial bus plug, Firewire® plug, receptacle or converter 32A comprises a miniature quick connect second housing 182, third connector portion 172A, and universal cable quick connect first mating connector portion 26A, wherein each of the connector portions 172A, 26A are in mechanical attachment with the second housing 182 and in electrical attachment with the cabling 190, thus allowing electrical communications between the connector portions 172A, 26A.

Similarly, the 6-Circuit plug 202, when used as the first modified second serial bus plug, Firewire® plug, receptacle or converter 36A comprises miniature quick connect second housing 182, fifth connector portion 176B, and universal cable quick connect second mating connector portion 26B, wherein each of the connector portions 176B, 26B are in mechanical attachment with the housing 182 and in electrical attachment with the cabling 190, thus allowing electrical communications between the connector portions 176B, 26B.

Illustrated in FIGS. 9A–D is a second modified first serial bus plug, Firewire® plug, receptacle, or converter 32B in the form of a 4 Pin USB Series "A" Receptacle 203, Rev. 2.0 (said standard being incorporated by reference herein in its entirety), having fifth pin arrangement 128 and a sixth pin arrangement 131 (substantially identical to second pin arrangement 116), which are mechanically and electrically connected per third pin-out diagram 129 and in electrical communication therewith.

The 4-pin USB Series "A" receptacle 203, when used as the second modified first serial bus plug, Firewire® plug, receptacle or converter 32B comprises miniature quick connect third housing 183, quick connect third mating connector portion 172A, quick connect first mating connector portion 26A, wherein each of the connector portions 172A, 26A are in mechanical attachment with the housing 183 and in electrical attachment with the cabling 190, thus allowing electrical communications between the connector portions 172A, 26A.

Similarly, the 4-Pin Series "A" receptacle 203, when used as the second modified second serial bus plug, Firewire® plug, receptacle or converter 36B comprises miniature quick connect third housing 183, fifth connector portion 176B, and quick connect second mating connector portion 26B, wherein each of the connector portions 176B, 26B are in mechanical attachment with the housing 183 and in electrical attachment with the cabling 190, thus allowing electrical communications between the connector portions 176B, 26B.

Illustrated in FIGS. 10A–D there is illustrated a third modified first serial bus plug, Firewire® plug, receptacle, or converter 32C in the form of a 4 Pin USB Series "A" Plug 204, Rev. 2.0 (said standard being incorporated by reference herein in its entirety), having a seventh pin arrangement 137 and an eighth pin arrangement 139 (substantially identical to second pin arrangement 116), which are mechanically and electrically connected per fourth pin-out diagram 135 and in electrical communication therewith.

The 4-Pin USB Series "A" plug 204, when used as the third modified first serial bus plug, Firewire® plug, receptacle or converter 32C comprises miniature quick connect fourth housing 184, third connector portion 172A, and universal cable quick connect first mating connector portion 26A, wherein each of the connector portions 172A, 26A are in mechanical attachment with the housing 184 and in electrical attachment with the cabling 190, thus allowing electrical communications between the connector portions 172A, 26A.

Similarly, the 4-Pin USB Series "A" plug 204, when used as the third modified second serial bus plug, Firewire® plug, receptacle or converter 36C comprises miniature quick connect fourth housing 184, fifth connector portion 176B, and universal cable quick connect second mating connector portion 26B, wherein each of the connector portions 176B, 26B are in mechanical attachment with the housing 184 and in electrical attachment with the cabling 190, thus allowing electrical communications between the connector portions 176B, 26B.

Illustrated in FIGS. 11A–D, is a fourth modified first serial bus plug, Firewire® plug, receptacle, or converter 32D in the form of a 4 Pin USB Series "B" Plug 205, Rev. 2.0 (said standard being incorporated by reference herein in its entirety), having a ninth pin arrangement 143 and a tenth pin arrangement 146 (substantially identical to second pin arrangement 116), which are mechanically and electrically connected per fifth pin-out diagram 147 and in electrical communication therewith.

The 4-Pin USB -Series "B" plug 205, when used as the fourth modified first serial bus plug, Firewire® plug, receptacle or converter 32D comprises miniature quick connect fifth housing 185, third connector portion 172A, and universal cable quick connect first mating connector portion 26A, wherein each of the connector portions 172A, 26A are in mechanical attachment with the housing 185 and in electrical attachment with the cabling 190, thus allowing electrical communications between the connector portions 172A, 26A.

Similarly, the 4-Pin USB Series "B" plug 205, when used as the fourth modified second serial bus plug, Firewire® plug, receptacle or converter 36D comprises miniature quick connect fifth housing 185, fifth connector portion 176B, and universal cable quick connect second mating connector-portion 26B, wherein each of the connector portions 176B, 26B are in mechanical attachment with the housing 185 and in electrical attachment with the cabling 190, thus allowing electrical communications between the connector portions 176B, 26B.

Illustrated in FIGS. 12A–D, is a fifth modified first serial bus plug, Firewire® plug, receptacle, or converter 32E in the form of a 5 Pin USB 2.0 Specification Mini-"A" Plug 206, Rev. 1.0 (said standard being incorporated by reference herein in its entirety), having an eleventh pin arrangement 152 and a twelfth pin arrangement 154 (substantially identical to second pin arrangement 116), which are mechanically and electrically connected per sixth pin-out diagram 151 and in electrical communication therewith.

The 5-Pin USB Mini-"A" plug 206 when used as the fifth modified first serial bus plug, Firewire® plug, receptacle or converter 32E comprises miniature quick connect sixth housing 186, third connector portion 172A, and universal cable quick connect first mating connector portion 26A, wherein each of the connector portions 172A, 26A are in mechanical attachment with the housing 186 and in electrical attachment with the cabling 190, thus allowing electrical communications between the connector portions 172A, 26A.

Similarly, the 5-Pin USB Mini "A" plug 206, when used as the fifth modified second serial bus plug, Firewire® plug, receptacle or converter 36E comprises miniature quick connect sixth housing 186, fifth connector portion 176B, and universal cable quick connect second mating connector portion 26B, wherein each of the connector portions 176B, 26B are in mechanical attachment with the housing 186 and in electrical attachment with the cabling 190, thus allowing electrical communications between the connector portions 176B, 26B.

Illustrated in FIGS. 13A–D, of the present invention, is a sixth modified first serial bus plug, Firewire® plug, receptacle, or converter 32F in the form of a 4 Pin USB 2.0 Specification Mini-"B" Plug 207, Rev. 1.0 (said standard being incorporated by reference herein in its entirety), having a thirteenth pin arrangement 158 and a fourteenth pin arrangement 162 (substantially identical to second pin arrangement 116), which are mechanically and electrically connected per seventh pin-out diagram 155 and in electrical communication therewith.

The 4-Pin USB-"Mini-B" plug 207, when used as the sixth modified first serial bus plug, Firewire® plug, receptacle or converter 32F, comprises miniature quick connect seventh housing 187, third connector portion 172A, and universal cable quick connect first mating connector portion 26A, wherein each of the connector portions 172A, 26A are in mechanical attachment with the housing 187 and in electrical attachment with the cabling 190, thus allowing electrical communications between the connector portions 172A, 26A.

Similarly, the 4-Pin USB "Mini-B" plug 207, when used as the sixth modified second serial bus plug, Firewire® plug, receptacle or converter 32F, comprises miniature quick connect seventh housing 187, fifth connector portion 176B, and universal cable quick connect second mating connector-portion 26B, wherein each of the connector portions 176B, 26B are in mechanical attachment with the housing 187 and in electrical attachment with the cabling 190, thus allowing electrical communications between the connector portions 176B, 26B.

Figure 14:
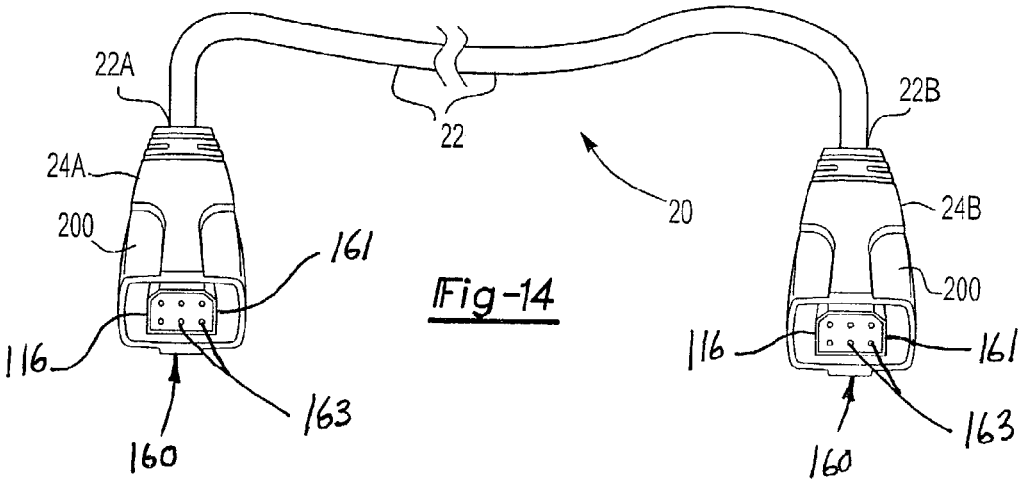
FIG. 14 is a partial perspective view of a construction embodying the present invention.

Referring to FIG. 14, since second pin arrangement 116, fourth pin arrangement 123, sixth pin arrangement 131, eighth pin arrangement 139, tenth pin arrangement 146, twelfth pin arrangement 154, fourteenth pin arrangement 162 and nth pin arrangement (not shown) are all substantially identical, a single universal cable 20 having a first universal cable connector portion 24A and a second universal cable connector portion 24B can accept all necessary plugs, receptacles or converters (conventional connectors 32,36) which are needed to connect computers, computer peripherals, computer related devices and other devices together.

First connector portion 24A and second connector portion 24B each have a connector housing 200, which preferably are identical. Mechanically attached to each connector housing 200 is a six pin female connector 160, such as that illustrated in FIGS. 4 and 6. Since each six pin female connector 160 has a female connector body 161, connector shelf 178, and female connection points 167, the six pin female connector 160 is easily connected to cable portion 22 of universal cable 20 by means well known in the art. Each six pin female connector 160 will be mechanically attached to connector housing 200, and electrically connected to cable portion 22.

A method of connecting computers to computer peripherals is provided utilizing a universal cable and a quick connect connector comprising the steps of: a) providing a universal computer cable (USB or Firewire®) 20 having a universal cable connector portion (female) (24A,24B) electrically connected to an end of the universal computer cable, b) providing a universal cable miniature quick connect connector having a universal cable quick connect mating connector portion (26A,26B), and c) connecting the universal cable connector to the quick connect connector by plugging the universal cable connector portion into the quick connect mating connector portion.

Also provided is a method of connecting external electrical equipment to computers and computer peripherals that comprises: a) providing a universal cable 20 having a universal cable first end 22A and second end 22B, wherein the universal cable first end has a universal cable first or female connector portion electrically connected thereto, which is in electrical communication with the universal cable second end 22B that is electrically connected to external electrical equipment, b) providing at least one quick connect serial bus plug or receptacle or converter 32 having a quick connect mating or male connector portion, and c) connecting the external electrical equipment to the at least one quick connect serial bus plug or receptacle or converter 32 by plugging the universal cable first connector portion 24A into the quick connect mating connector 26A.

Because the universal cable connector portions, and the quick connect mating connector portions may remain unchanged and accommodate a large number of first and/or second serial bus plugs, Firewire® plugs receptacles and/or converters, a truly universal cable system is provided.

What is claimed is:

1. A universal cable system for transferring data signals between a pair of electrical devices having conventional connectors comprising:

a universal cable for transferring data signals including a universal cable portion having six conductors each extending between opposite ends of said universal cable portion;

a separate universal cable connector portion attached to each of said ends of said universal cable portion, each said universal cable connector portion having a conductive connector body with six first pins disposed therein, each of said first pins being electrically connected to an associated one of said conductors, said first pins being arranged in two parallel rows of three of said first pins; and at least a pair of quick connect mating connector portions each adapted to releasably engage each of said universal cable connector portions, each said quick connect mating connector portion having a quick connect body with six second pins mounted at a first end to mechanically and electrically connect with said six first pins, said quick connect body having a conventional connector mounted at a second end for engagement with a mating conventional connector of a device, said conventional connector being electrically connected to said second pins and being incapable of mating with said universal cable connector portions.

2. The universal cable system according to claim 1 including a connector shelf disposed in each said connector body between said two rows of first pins.

3. The universal cable system according to claim 1 wherein said six pins are all female pins or male pins.

4. The universal cable system according to claim 1 wherein each said conventional connector is one of a 4-circuit plug, a 6-circuit plug, an "A" receptacle, an "A" plug, a "B" plug, a mini-"A" plug and a mini-"B" plug.

5. The universal cable system according to claim 1 including a plurality of said quick connect mating connector portions, a first of said quick connect mating portions having said conventional connector being an "A" receptacle, a second of said quick connect mating portions having said conventional connector being an "A" plug, a third of said quick connect mating portions having said conventional connector being a "B" plug, a fourth of said quick connect mating portions having said conventional connector being a mini-"A" plug and a fifth of said quick connect mating portions having said conventional connector being a mini-"B" plug.

6. The universal cable system according to claim 1 wherein a first of said quick connect mating portions has said conventional connector being a 4-circuit plug and a second of said quick connect mating portions has said conventional connector being a 6-circuit plug.

7. A universal cable system for transferring data signals between a pair of electrical devices having conventional connectors comprising:

a universal cable for transferring data signals including a universal cable portion having six conductors each extending between opposite ends of said universal cable portion;

a separate universal cable connector portion attached to each of said ends of said universal cable portion, each said universal cable connector portion having a conductive connector body with six first pins disposed therein, each of said first pins being electrically connected to an associated one of said conductors, said first pins being arranged in two parallel rows of three of said first pins;

a first quick connect mating connector portion adapted to releasably engage each of said universal cable connector portions, said first quick connect mating connector portion having a quick connect body with six second pins mounted at a first end to mechanically and electrically connect with said six first pins, said first quick connect body having a first conventional connector mounted at a second end for engagement with a mating conventional connector of a device, said first conventional connector being electrically connected to said second pins and being incapable of mating with said universal cable connector portions, said first conventional connector being one of a 4-circuit plug, a 6-circuit plug, an "A" receptacle, an "A" plug, a "B" plug, a mini-"A" plug and a mini-"B" plug; and a second quick connect mating connector portion adapted to releasably engage each of said universal cable connector portions, said second quick connect mating connector portion having a quick connect body with six third pins mounted at a first end to mechanically and electrically connect with said six first pins, said second quick connect body having a second conventional connector mounted at a second end for engagement wit a mating conventional connector of a device, said second conventional connector being electrically connected to said third pins and being incapable of mating with said universal cable connector portions, said second conventional connector being one of a 4-circuit plug, a 6-circuit plug, an "A" receptacle, an "A" plug, a "B" plug, a mini-"A" plug and a mini-"B" plug.

* * * * *